US006354695B1

(12) United States Patent
Kim et al.

(10) Patent No.: US 6,354,695 B1
(45) Date of Patent: Mar. 12, 2002

(54) INK-JET PRINTHEAD

(75) Inventors: Jeong-seon Kim; Jae-ho Moon, both of Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/834,900

(22) Filed: Apr. 16, 2001

(30) Foreign Application Priority Data

Dec. 13, 2000 (KR) ..... 2000-75936

(51) Int. Cl.[7] ..... B41J 2/14; B41J 2/16

(52) U.S. Cl. ..... 347/48

(58) Field of Search ..... 347/48, 62, 63, 347/67, 44, 47, 56, 61

(56) References Cited

U.S. PATENT DOCUMENTS 4,894,664 A * 1/1990 Pan ..... 347/63
5,760,804 A * 6/1998 Heinzl ..... 347/56

* cited by examiner

*Primary Examiner*—John Barlow
*Assistant Examiner*—Juanita D. Stephens
(74) *Attorney, Agent, or Firm*—Robert E. Bushnell, Esq.

(57) ABSTRACT

A bubble-jet type ink-jet printhead is provided. The printhead has an ink channel having a simple structure, thereby significantly suppressing clogging of nozzles by particles or solidified ink. The printhead is easy to design and manufacture due to its simple structure, thereby significantly reducing the manufacturing cost. In particular, its simple structure permits flexibility in selecting a wide range of alternative designs and thus patterns in which the nozzles are arranged. Furthermore, the printhead can be manufactured by a fabrication process for a typical semiconductor device, thereby facilitating high volume production.

20 Claims, 17 Drawing Sheets

INK-JET PRINTHEAD

CLAIM OF PRIORITY his application makes reference to, incorporates the same herein, and claims all benefits accruing under 35 U.S.C. §119 from my application entitled INK-JET PRINT HEAD filed with the Korean Industrial Property Office on Dec. 13, 2000 and there duly assigned Ser. No. 2000/75936

BACKGROUND OF THE INVENTION

1. Field of the Invention

The present invention relates to an ink-jet printhead, and more particularly, to a bubble-jet type ink-jet printhead.

2. Description of the Related Art

The ink ejection mechanisms of an ink-jet printer are largely categorized into two types: an electro-thermal transducer type (bubble-jet type) in which a heat source is employed to form a bubble in ink causing ink droplets to be ejected, and an electro-mechanical transducer type in which a piezoelectric crystal bends to change the volume of ink causing ink droplets to be expelled.

Meanwhile, an ink-jet printhead having this bubble-jet type ink ejector needs to meet the following conditions. First, a simplified manufacturing procedure, low manufacturing cost, and high volume production must be allowed. Second, to produce high quality color images, creation of minute satellite droplets that trail ejected main droplets must be prevented. Third, when ink is ejected from one nozzle or ink refills an ink chamber after ink ejection, cross-talk with adjacent nozzles from which no ink is ejected must be prevented. To this end, a back flow of ink in the opposite direction of a nozzle must be avoided during ink ejection. Fourth, for a high speed print, a cycle beginning with ink ejection and ending with ink refill must be as short as possible. Fifth, a nozzle and an ink channel for introducing ink into the nozzle must not be clogged by foreign materials or solidified ink.

However, the above conditions tend to conflict with one another, and furthermore, the performance of an ink-jet printhead is closely associated with structures of an ink chamber, an ink channel, and a heater, the type of formation and expansion of bubbles, and the relative size of each component.

In efforts to overcome problems related to the above requirements, ink-jet print heads having a variety of structures have been proposed in U.S. Pat. Nos. 4,339,762; 4,882,595; 5,760,804; 4,847,630; and 5,850,241, European Patent No. 317,171, and Fan-Gang Tseng, Chang-Jin Kim, and Chih-Ming Ho, "A Novel Micoinjector with Virtual Chamber Neck", IEEE MEMS '98, pp. 57–62. However, ink-jet printheads proposed in the above patents and literature may satisfy some of the aforementioned requirements but do not completely provide an improved ink-jet printing approach.

Thus, due to the complicated structures of the conventional ink-jet printheads, the fabrication process is very complex and the manufacturing cost is very high. Furthermore, each ink channel having a complicated structure has a different fluid resistance to ink supplied to each chamber, which results in large differences in the amount of ink supplied to each chamber. Thus, this raises design concerns for adjusting the difference. Due to the complicated structures of the ink channel and ink chamber connected thereto, foreign materials may adhere to the ink channel and ink chamber or ink may solidify, which may not only cause an obstacle to supplying ink to the ink chamber but may also clog the ink channel or the nozzle rendering it unusable.

Meanwhile, an ink-jet printhead disclosed in U.S. Pat. No. 4,847,630 is constructed such that an annular heater surrounding each nozzle, from which ink is ejected, is formed in a nozzle plate, and a C-shaped isolation wall, one side of which is open, is disposed in the vicinity of the heater. The ink-jet print head printhead constructed such that the heater and the isolation wall are formed in the same nozzle plate is advantageous in reducing offset between the nozzle and the heater. However, heat loss due to the nozzle plate is large and the structure is complicated since the ink chamber formed by the isolation wall is provided for each nozzle.

SUMMARY OF THE INVENTION

To solve the above problems, it is an object of the present invention to provide a bubble-jet type ink-jet printhead having a simplified structure which is simple to manufacture, especially for high volume production.

It is another object of the present invention to provide a bubble-jet type ink-jet printhead which is capable of effectively preventing adhesion of foreign materials and ink solidification and clogging.

It is still another object of the present invention to provide a bubble-jet type ink-jet printhead which has a low manufacturing cost and a long lifetime.

It is still another object of the invention to provide a bubble-jet type ink-jet printhead having a self-cleaning function.

It is further an object of the present invention to provide an ink-jet printhead that ejects smaller ink droplets thus allowing for a high resolution print on a sheet of recording medium.

It is still further an object of the present invention to provide an ink-jet printhead that prevents a backflow of ink which would prevent the operation of one nozzle from affecting the operation of a neighboring nozzle.

It is also an object of the present invention to provide an ink-jet printhead that has a quick response rate and is capable of being operated at a high driving frequency.

It is still also an object of the present invention to provide an ink-jet printhead where upon applying power, a bubble is formed which coalesces at a center of the nozzle, preventing the formation of satellite droplets.

Accordingly, to achieve the above objectives, the present invention provides a bubble-jet type ink jet printhead having a substrate, a nozzle plate including a plurality of nozzles, which is fixed to the substrate by an adhesive layer, a plurality of concave portions formed on the substrate, each of which corresponds to each of the plurality of nozzles, a plurality of resistive layers formed along the bottoms of the plurality of concave portions, each resistive layer surrounding the central axis that passes through the corresponding nozzle, and a plurality of ink feed grooves formed opposite the plurality of nozzles at the bottom center portions of the concave portions, the ink feed grooves being aligned with each of the nozzles so that the central axis of the ink feed grooves coincides with respective ones of the central axis of each of the nozzles. A portion of each nozzle opposing the substrate has a diameter large enough to surround each resistive layer, and a vibration element is disposed on the bottom of the substrate. Furthermore, a plurality of ink inlets, the lower portions of which are widely open, connect with the plurality of ink feed grooves, respectively.

The resistive layer has a doughnut shape, one side of which is open, an omega shape, or a polygonal frame. Each resistive layer has resistance that varies at regular intervals. The resistance of the resistive layer is adjusted by the width or height of the resistive layer. Preferably, a thermal insulating layer is formed on the substrate, on top of which the resistive layer is formed. In particular, a protective layer for protecting the resistive layer is preferably formed on the resistive layer

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
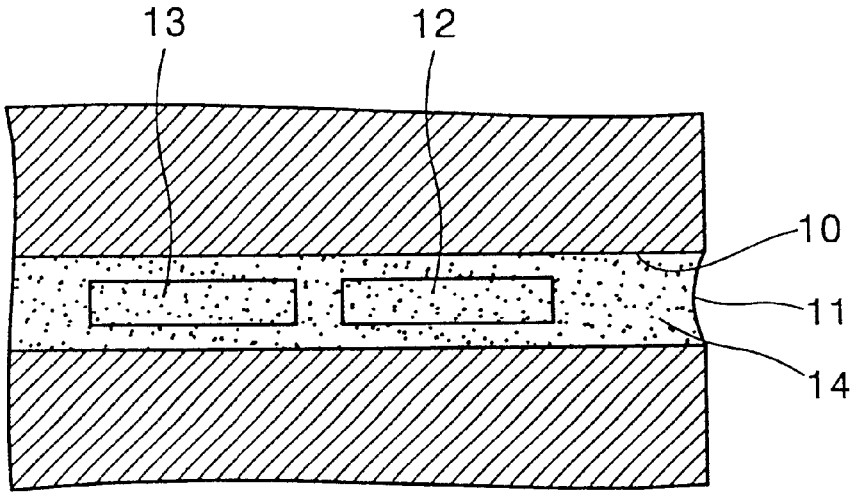
FIGS. 1A and 1B are cross-sectional views showing the structure of a bubble-jet ink jet printhead along with an ink ejection mechanism.
Figure 1B:
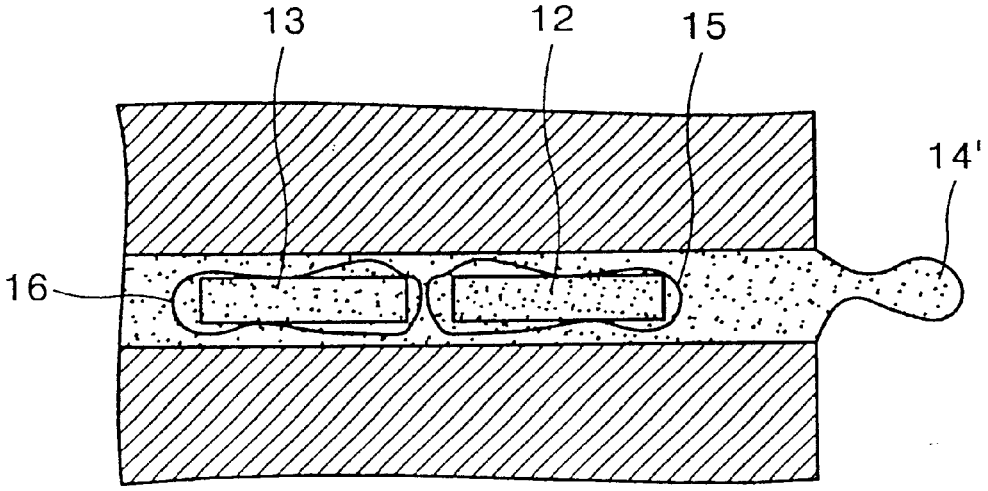

Referring to FIGS. 1A and 1B, a bubble-jet type ink ejection mechanism will now be described. When a current pulse is applied to a first heater 12 consisting of resistive heating elements formed in an ink channel 10 where a nozzle 11 is located, heat generated by the first heater 12 boils ink 14 to form a bubble 15 within the ink channel 10, which causes an ink droplet 14' to be ejected.

In FIGS. 1A and 1B, a second heater 13 is provided so as to prevent a back flow of the ink 14. First, the second heater 13 generates heat, which causes a bubble 16 to shut off the ink channel 10 behind the first heater 10. Then, the first heater 12 generates heat and the bubble 15 expands to cause the ink droplet 14' to be ejected.

Figure 2:
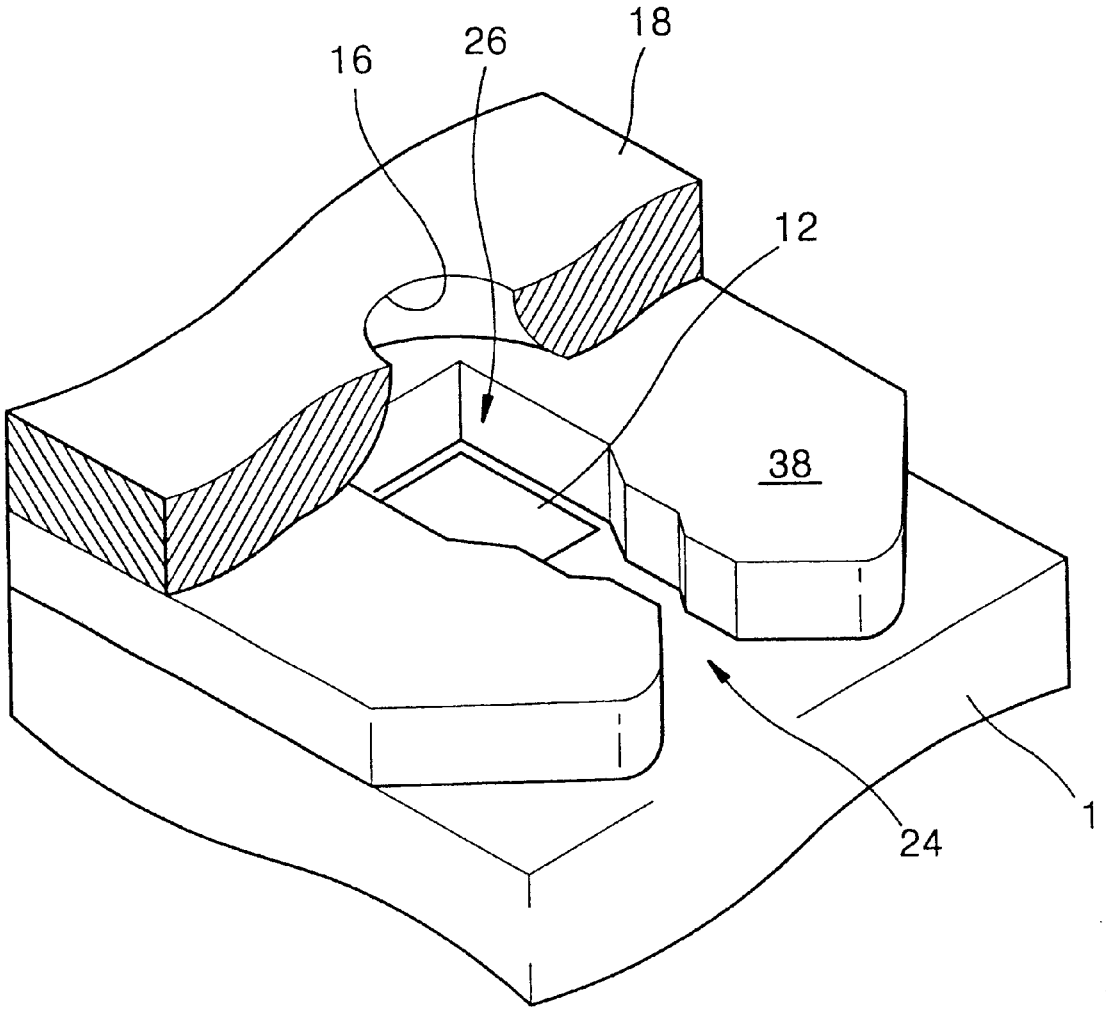
FIG. 2(PRIOR ART)
FIG. 2 is a perspective view of a portion of a conventional bubble-jet type ink-jet printhead.

FIG. 2 is an extract drawing showing an ink-jet printhead disclosed in U.S. Pat. No. 4,882,595. Referring to FIG. 2, a chamber 26 for providing for a space where a heater 12 formed on a substrate 1 is located, and an intermediate layer 38 for forming an ink channel 24 for introducing ink into the chamber 26 are provided. A nozzle plate 18 having a nozzle 16 corresponding to the chamber 26 is disposed on the intermediate layer 38.

Figure 3:
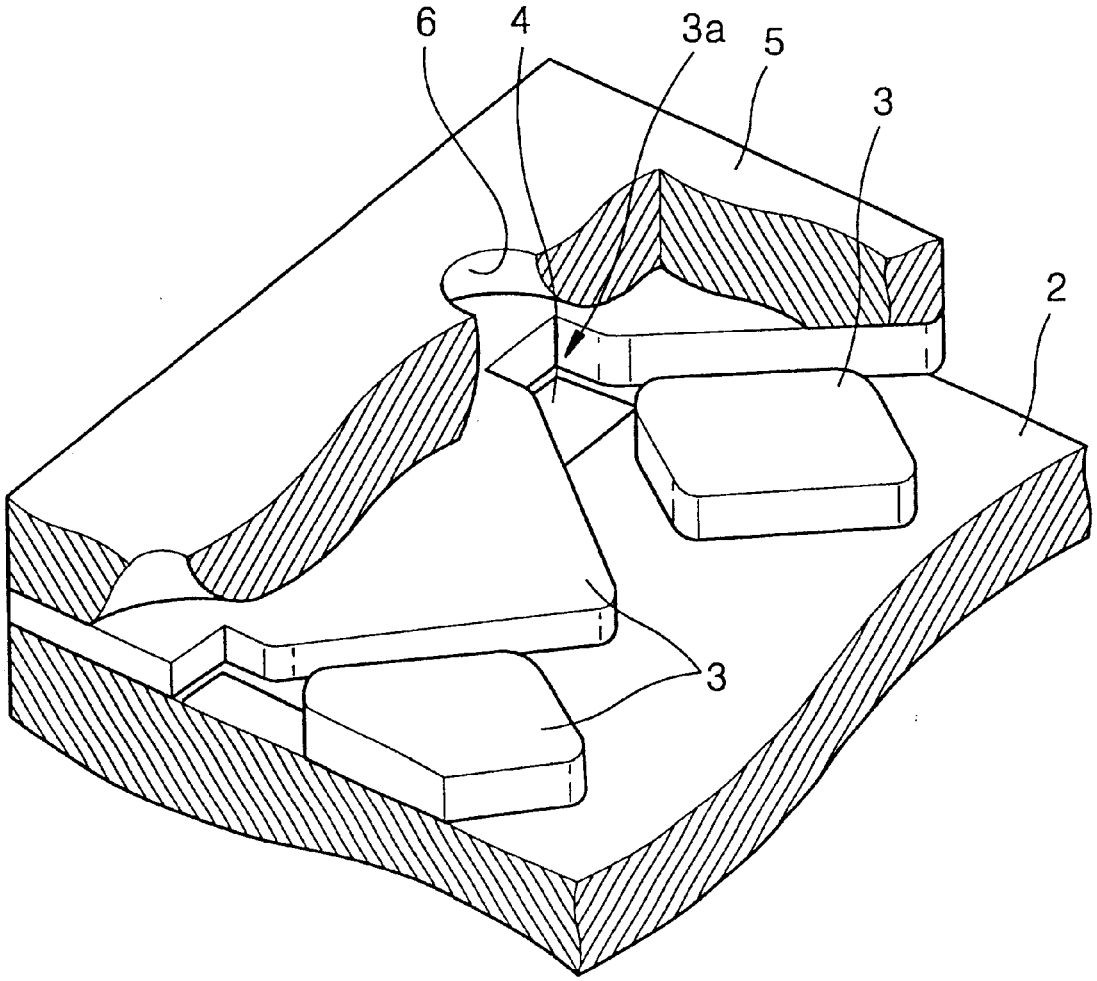
FIG. 3(PRIOR ART)
FIG. 3 is a perspective view of a portion of a conventional bubble-jet type ink-jet printhead.

FIG. 3 is an extract drawing showing an ink-jet printhead disclosed in U.S. Pat. No. 5,912,685. Referring to FIG. 3, a chamber 3*a* in which a heater resistor 4 is disposed, and an intermediate layer 3 for offering an ink channel for introducing ink into the ink chamber 3*a* are disposed on a substrate 2. A nozzle plate 5 including a nozzle 6 corresponding to the chamber 3*a* is formed on the intermediate layer 3.

In the ink-jet printheads disclosed in the above-cited references including the conventional ink-jet printheads shown in FIGS. 2 and 3, one chamber is allocated for each nozzle and an ink channel having a complicated structure is provided for supplying ink from an ink feed cartridge to each chamber.

Figure 4:
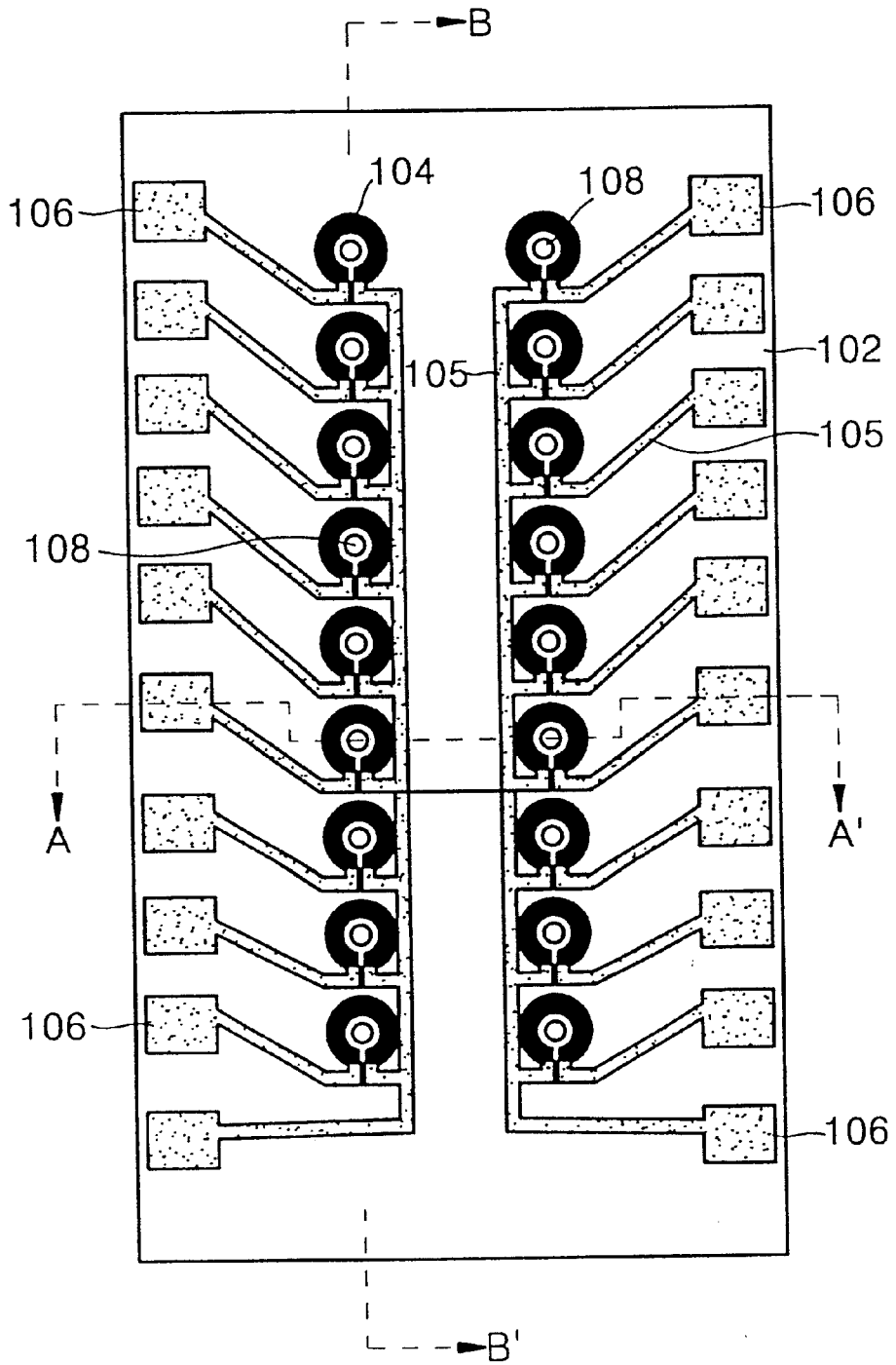
FIG. 4 is a schematic top view showing the state in which a nozzle plate is not provided in the bubble-jet type ink-jet printhead according to a first embodiment of the present invention shown in FIG. 4.
Figure 5:
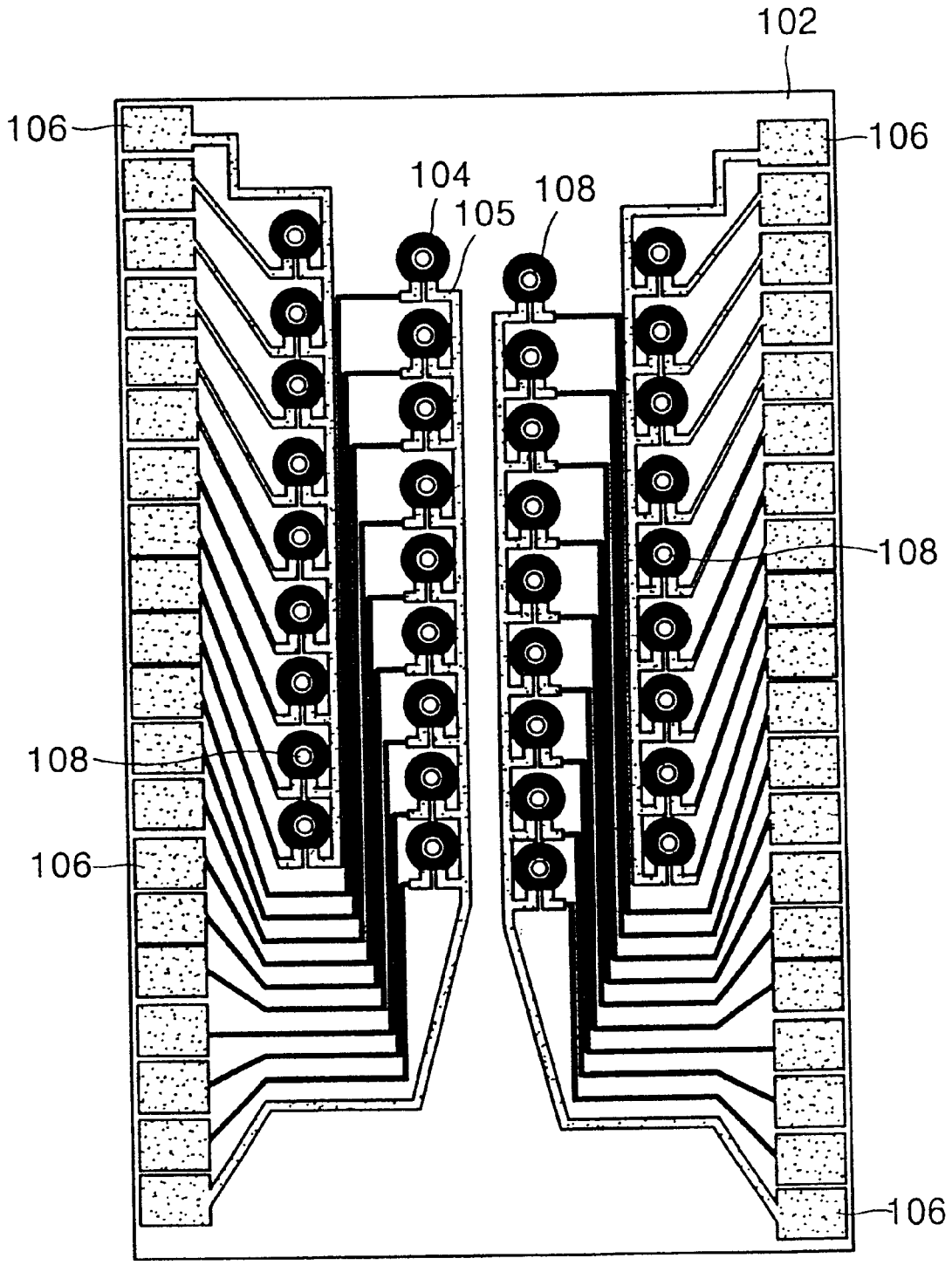
FIG. 5 is a schematic top view of a substrate in which a nozzle plate is not provided in a bubble-jet type ink-jet printhead according to a second embodiment of the present invention.

Referring to FIG. 4 which is a top view of a substrate from which a nozzle plate is separated according to a first embodiment of the present invention, a plurality of omega-shaped resistive layers 104 are disposed at the bottom of a substrate 102. An ink feed groove 108 that penetrates the substrate 102 is formed at the center portion of each resistive layer 104. The resistive layers 104 are arranged in two rows in a longitudinal direction of the substrate 102. In this embodiment, the ink feed grooves 108 and the resistive layers 104 associated therewith are arranged in two rows, respectively, but they may be arranged in one row. In order to achieve high resolution, they may be arranged in three rows, or in four or more rows like in a bubble-jet type ink-jet printhead according to a second embodiment of the present invention shown in FIG. 5.

Meanwhile, a plurality of electrically conductive layers 105 are connected to the resistive layers 104, and the wiring layers 105 extend to the edges of the substrate 102 where they are coupled to a plurality of pads 106. Each pad 106 on the substrate 100 contacts each terminal 201 disposed on a flexible printed circuit (FPC) board as in conventional ink-jet printheads.

Figure 6:
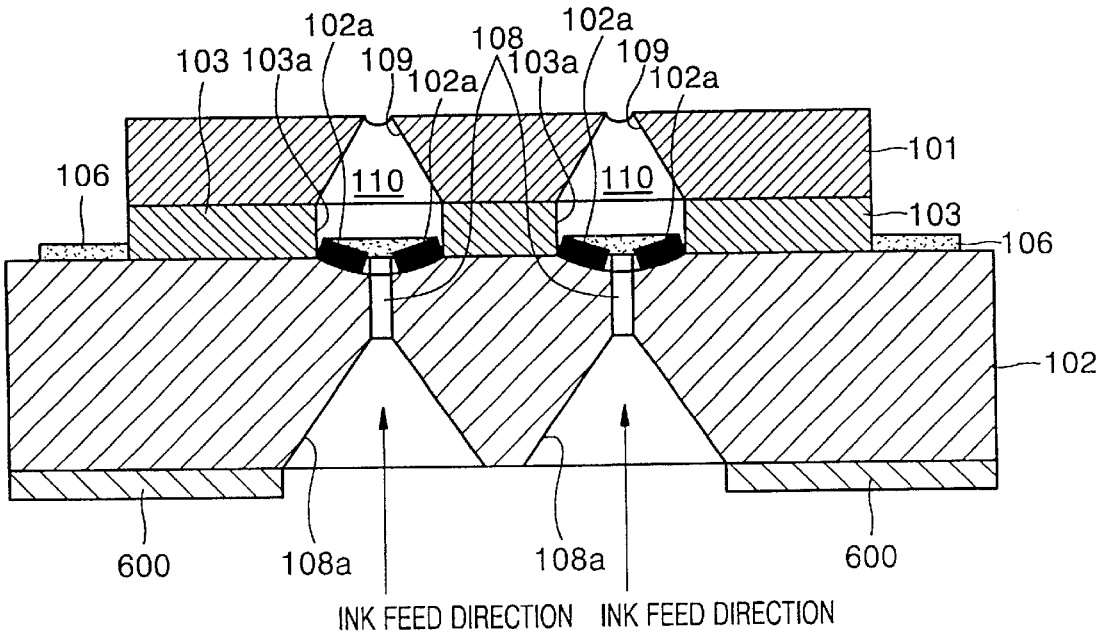
FIGS. 6 and 7 are cross-sectional views of the bubble-jet type ink-jet printhead according to the present invention taken along lines A–A' and B–B' of FIG. 4, respectively.
Figure 7:
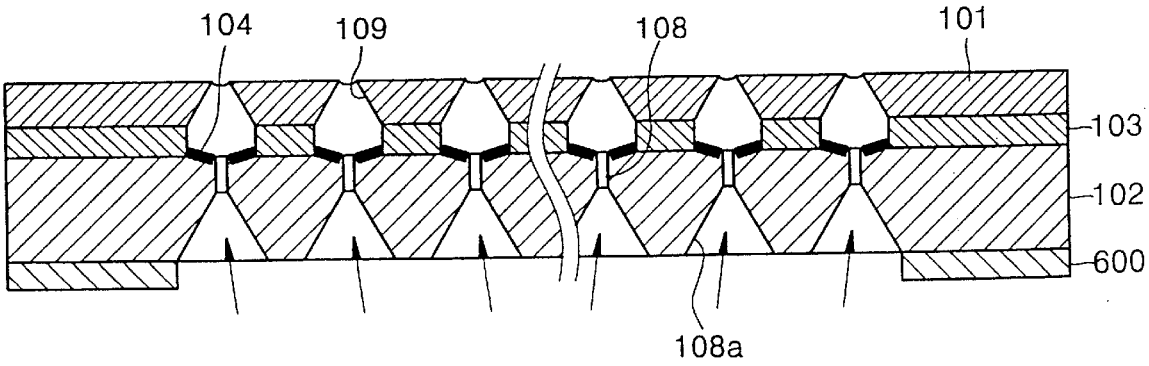

FIGS. 6 and 7 are cross-sectional views of the ink-jet printhead according to the first embodiment of the present invention taken along lines A–A' and B–B' of FIG. 4 when the nozzle plate 101 is attached to the substrate 102. As shown in FIGS. 6 and 7, the nozzle plate 101 is attached to the substrate 102 by an adhesive layer 103, and the adhesive layer 103 has a through hole 103*a* corresponding to each resistive layer 104. A plurality of conical or truncated conical nozzles 109 (or orifices) having a lower diameter large enough to surround the corresponding annular resistive layers 104 are formed in the nozzle plate 101. Here, the inside of each nozzle 109 of the nozzle plate 101 is a unit chamber 110. Ink is supplied to the unit ink chamber 110 through the ink feed groove 108 disposed below the unit ink chamber 110, then a bubble is generated within the nozzle 109 by heat from the resistive layer 104 disposed around the ink feed groove 108, and finally ink present in the nozzle 109 is ejected by expansion energy of the bubble.

Meanwhile, the ink feed groove 108 for penetrating the center portion of the resistive layer 104 is formed in the substrate 102. A conical or truncated conical ink inlet 108*a,* the lower portion of which is widely open, is formed below the ink feed groove 108. A tray-type concave portion 102*a* slanted toward the central axis thereof that passes through the ink feed groove 108 is formed in a portion where the resistive layer 104 is formed. The top surface of the resistive layer 104 formed in the concave portion 102*a* is slanted toward the center of the nozzle 109. A vibration element 600 such as a piezo element is disposed on the bottom of the substrate 102 as one of the selective elements for cleaning particles accumulated on and between the substrate 102 and the nozzle plate 101.

Figure 8:
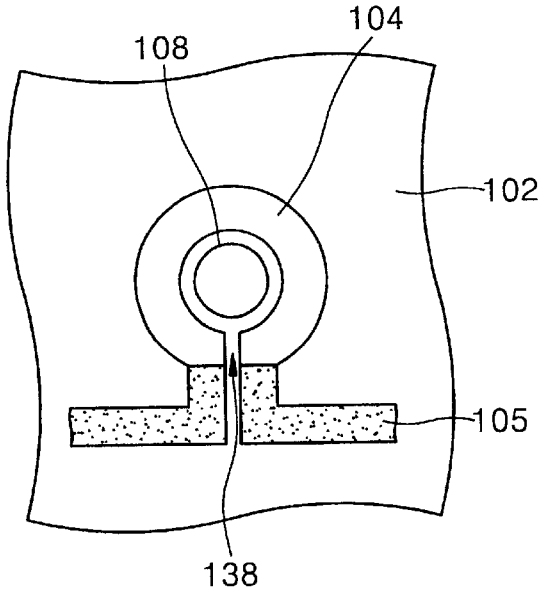
FIG. 8 is a top view showing the relationship between a resistive layer formed on the substrate and a corresponding ink feed groove in a bubble-jet type ink-jet printhead according to the present invention.

A process of ejecting ink for a bubble-jet type ink-jet printhead according to the present invention having the above structure will now be described. FIG. 8 shows the resistive layer 104 formed on the substrate 102 and the ink feed groove 108 disposed coaxially inside the resistive layer 104. FIG. 8 illustrates a doughnut-shaped resistive layer 104 which is open and discontinuous at opening 138. The ends of resistive layer 104 are attached to electrodes or signal lines 105.

Figure 9:
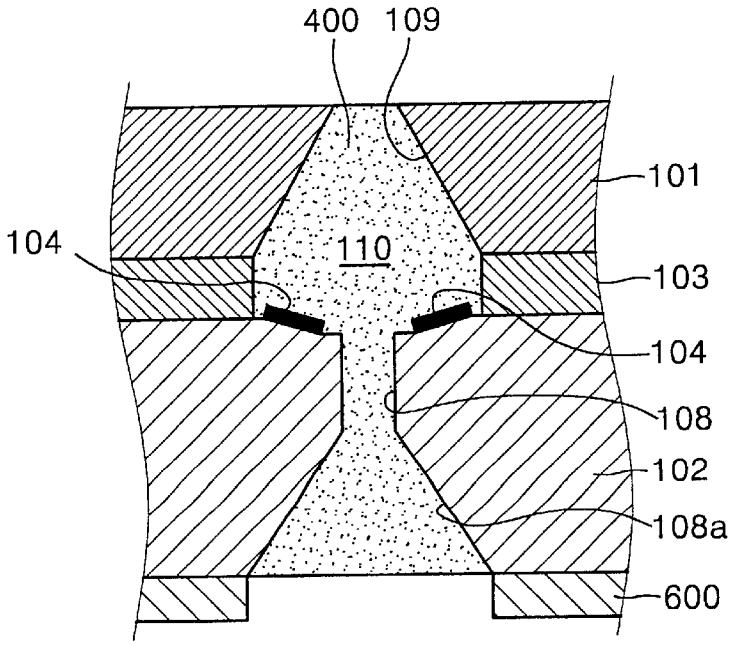
FIGS. 9–12 are schematic cross-sectional views showing the formation and growth of a doughnut-shaped bubble, ejection of an ink droplet, and shrinkage of the bubble in a bubble-jet type ink-jet printhead according to the present invention.

FIGS. 9–12 show steps of formation of a doughnut-shaped bubble due to heat from the resistive layer 104, growth of the bubble, ejection of an ink droplet, shrinkage of the bubble, and refill of ink. First, as shown in FIG. 8, the resistive layer 104 is formed and arranged in such a way as to encircle an axis passing through the center of the nozzle 109 and the ink feed groove. Thus, if a DC pulse is applied to the resistive layer 104, heat rapidly generated from the resistive layer 104 boils ink, thereby forming a doughnut-shaped bubble corresponding to the shape of the resistive layer 104. FIG. 9 shows a state in which no power is applied to the resistive layer 104. In this case, ink 400 fills the common chamber 110. The ink 400 is supplied to the common chamber by capillary action.

Figure 10:
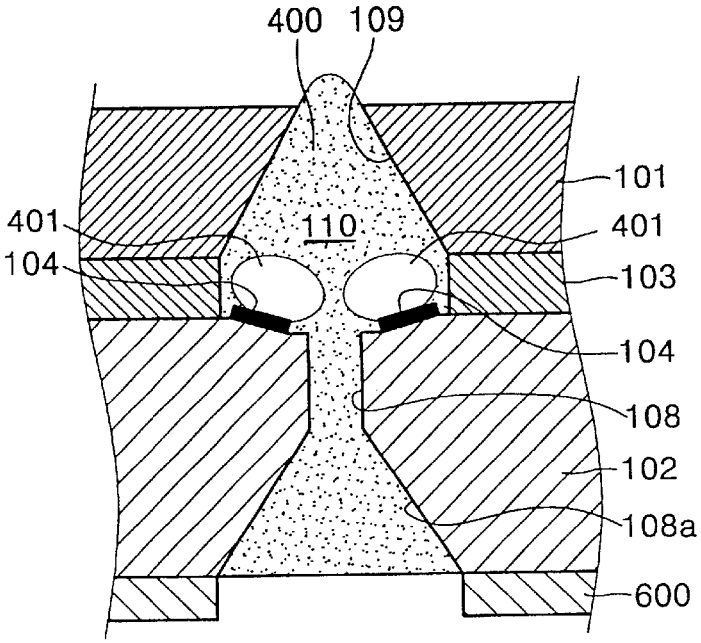

FIG. 10 shows a state in which a doughnut-shaped bubble 401 is formed by the resistive layer 104, to which the DC pulse is applied. As shown in FIG. 10, the ink 400 present in the unit ink chamber 110 within the nozzle 109 is separated from ink present in the ink feed groove 108 disposed below the unit ink chamber 110 and then compressed by the bubble 401, attempting ejection through the nozzle 109.

Figure 11:
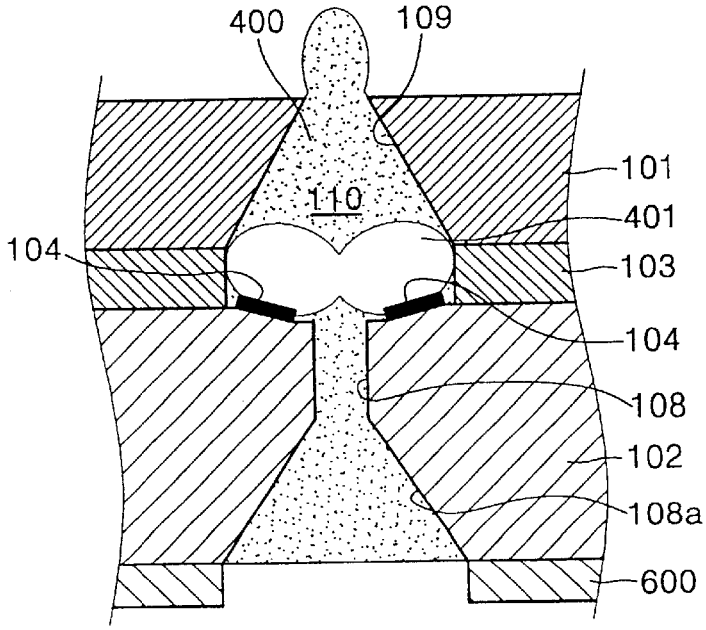
Figure 12:
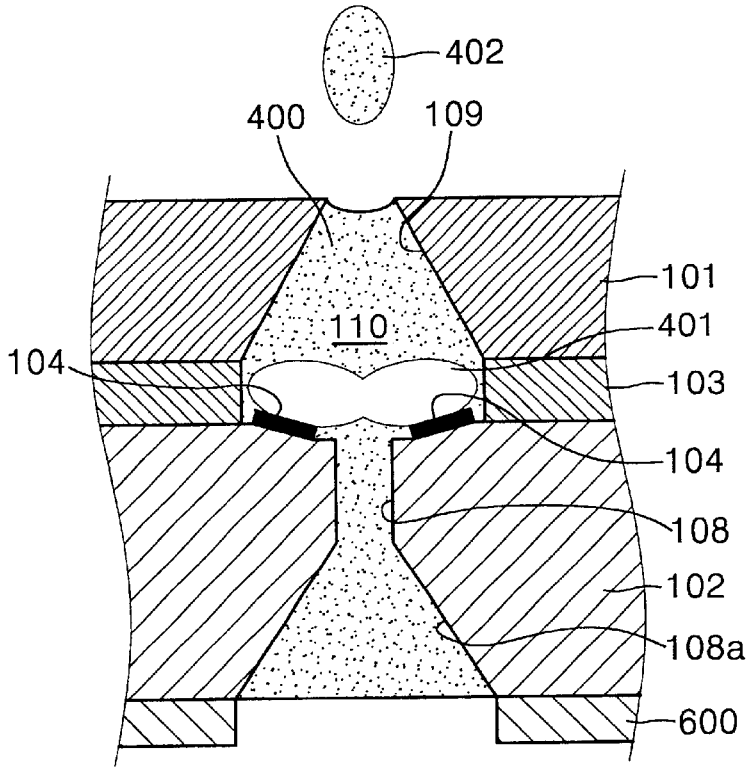

FIG. 11 shows a state in which the doughnut-shaped bubble 401 has reached its maximum growth. A portion below the unit ink chamber 110 is closed by the maximum growth of the doughnut-shaped bubble 401, thus causing an ink droplet 402 to exit through the nozzle 109. FIG. 12 is a state in which the bubble 401 is shrunk after ejection of the ink droplet 402 through the nozzle 109 due to the cooling of the resistive layer 104. As the bubble 401 shrinks, the ink 400 begins to refill, which returns to the state shown in FIG. 9. The shrinkage of the bubble 401 is attributed to the cooling of the resistive layer 104 due to the cutoff of the DC pulse.

According to the present invention described above, the doughnut-shaped bubble 401 is grown toward the center portion of the nozzle by the resistive layer 104 designed so that the surface is slanted toward the center portion of the nozzle 109, thereby facilitating high-speed ink ejection. Along with this, the ink feed groove 108 is closed when the bubble 401 reaches its maximum growth, thus preventing the ink back flow due to force applied by expansion of the bubble 401. Furthermore, a limited amount of ink isolated within the unit ink chamber 110 is ejected thereby making the volume of droplets smaller and preventing the formation of satellite droplets. Furthermore, the area of the annular heater 104 is so wide as to be rapidly heated and cooled, which quickens the cycle from the formation to the collapse of the bubble 401, thereby allowing for a quick response rate and high driving frequency.

Figure 13:
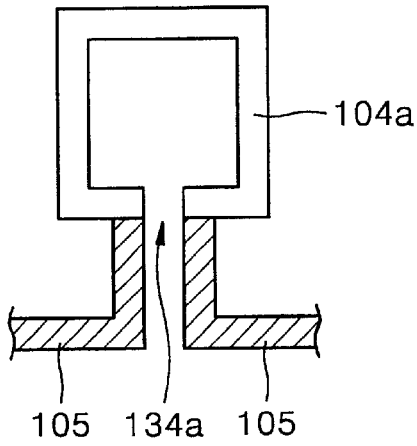
FIGS. 13–21 show a modified example of a resistive layer of a bubble-jet type ink-jet printhead according to the present invention.
Figure 14:
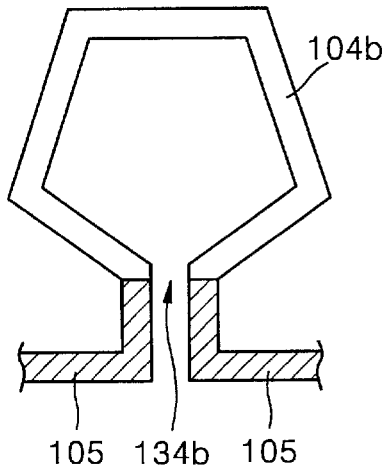

In this embodiment, the doughnut-shaped resistive layer 104 can be modified into another form. For example, the doughnut-shaped resistive layer 104 may be replaced with a resistive layer 104*a* having a rectangular frame as shown in FIG. 13 or a resistive layer 104*b* having a pentagonal frame as shown in FIG. 14. Resistive layers 104*a* and 104*b* are open and discontinuous as exemplified by opening 134*a* and 134*b* respectively. Each end of resistive layers 104*a* and 104*b* are electrically connected to electrodes 105. Thus, the shape of the resistive layers 104, 104*a,* and 104*b* does not restrict the technical scope of the present invention. In an ink-jet printhead according to the present invention, the resistive layer 104 may take on a variety of different forms surrounding the central axis of the nozzle 109 associated therewith by a predetermined space.

Another example of the resistive layer applied to a bubble-jet type ink-jet printhead according to the present invention will now be described with reference to FIGS. 15–21. First, referring to FIG. 15, a resistive layer 104*c* has a circular inner edge 144*c* and a rounded, pentagonal-shaped outer edge 154*c,* between which body 174*c* of heater 104*c* is disposed. It is noted that body 174*c* has varying widths at varying locations, causing the resistance of heater 104*c* to vary at different locations. Thus, the resistive layer 104*c* includes a low resistance portion B, in which the width is large, and a high resistance portion A, in which the width is small. Two low resistance portions B, which are symmetrical to each other, are coupled to the electrically conductive layers 105, respectively. Thus, a parallel circuit of resistors having two current paths is constructed between the electrically conductive wiring layers 105.

Predetermined current is applied to the resistive layer 104*c* through the wiring layers 105 and then the entire resistive layer 105 starts to generate heat. In this case, a temperature rise rate of the high resistance portion A is higher than that of the low resistance portion B due to the difference in resistance at each portion of the resistive layer 104*c*. The temperature at each portion of the resistive layer 104*c* varies due to the difference in temperature rise rate. As shown in the left side of FIG. 16, first, a bubble A' is formed due to a sharp temperature rise at the high resistance portion A of the resistive layer 104*c,* and then, as shown in the right side of FIG. 16, the bubble A' generated at the high resistance portion A further grows and a bubble B' starts to be formed at the low resistance portion B as well. That is, when a predetermined period of time has lapsed after application of the current, the bubbles A' and B' formed by ink heated by the resistive layer 104*c* have the difference in volumes corresponding to the heat generation amount, and differences in the volumes of the bubbles A' and B' are entirely symmetrical or balanced.

In this way, the present invention artificially imparts periodical changes in resistance to the resistive layer when designing and manufacturing the resistive layer, thereby allowing for balanced heat generation by the entire resistive layer and thus symmetrical bubble growth. The reason for artificially imparting periodical changes in resistance will be more easily understood by what will be described below.

Figure 17:
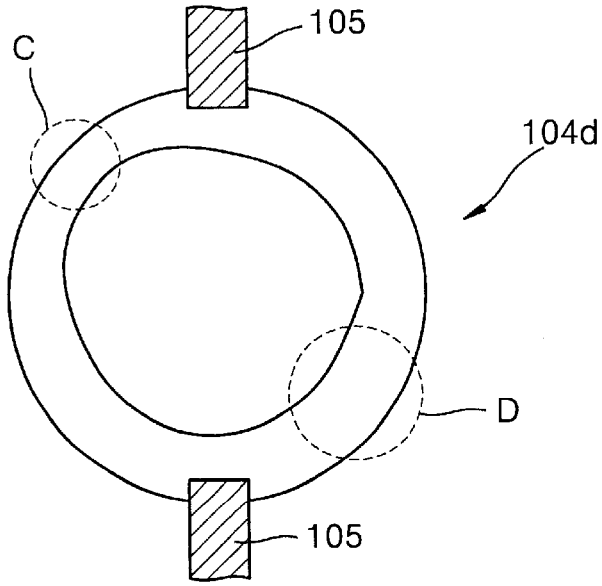

FIG. 17 shows a doughnut-shaped resistive layer 104*d* which was originally designed as a normal circle. Referring to FIG. 10, opposite ends of the resistive layer 104*d* designed and manufactured such that both inner and outer edges may have circular shapes, are coupled to the wiring layers 105. Unlike the design of the resistive layer 104*d*, during an actual manufacture, resistance of the resistive layer 104*d* itself is not made uniform due to variations in local etching amount of the resistive layer 104*d*. Changes in local resistance of the resistive layer 104*d* cannot be predicted since they are caused by errors during material deposition and etching processes during formation of the resistive layer 104*d*.

Figure 15:
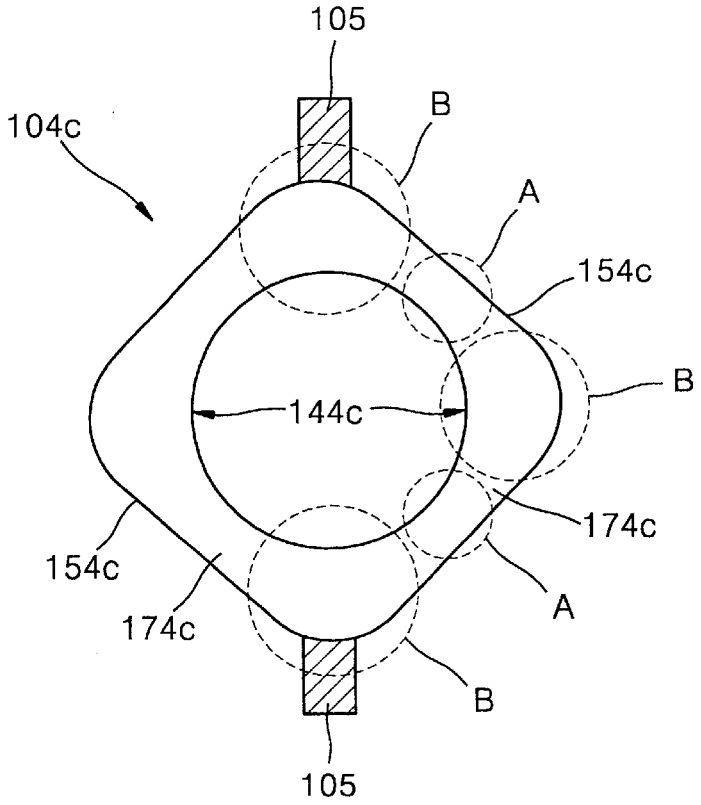
Figure 16:
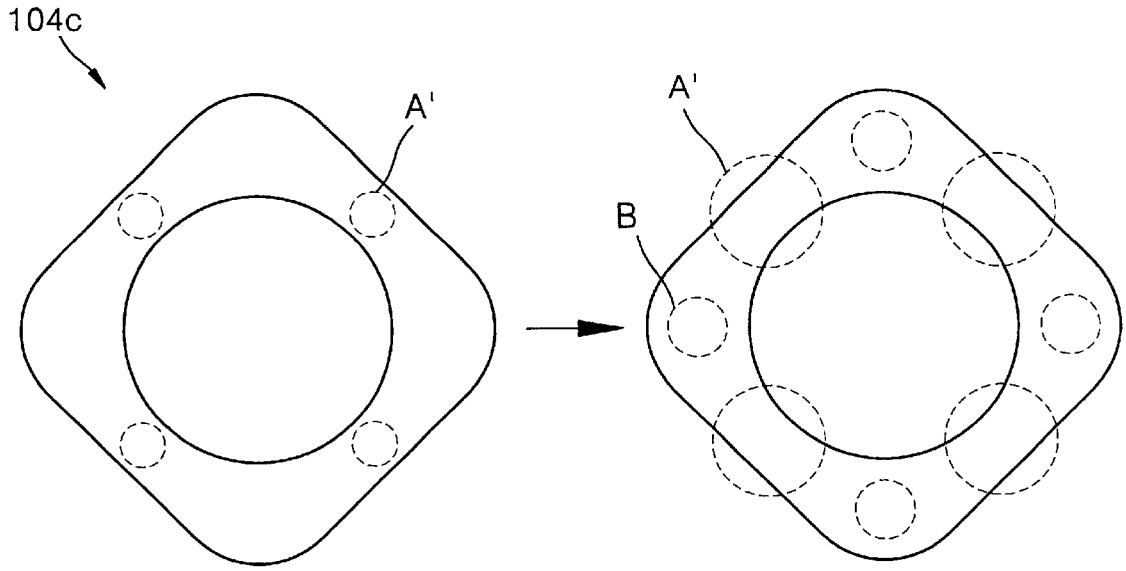

C and D in FIG. 17, which may be created by a process error, denote high resistance portions having higher resistance than the remaining portions, and there may be difference in resistance between both high resistance portions C and D. Thus, since the resistance of the resistive layer 104*d* as shown in FIG. 17 is connected in parallel, and the high resistance portions C and D having a high temperature rise rate compared to the other portions exist in parallel. In this case, since bubbles are firstly formed at the high resistance portions C and D as described above, the bubble is formed in an abnormal manner, for example, the overall shape of the bubble is distorted or one side of the bubble is vacant. This abnormal formation of the bubbles may cause ink within an ink chamber to be ejected in an abnormal direction. To overcome this drawback, as shown in FIG. 15, the present invention adjusts the shape of the resistive layer from the design stage so as to make abnormally shaped bubbles due to a process error normal, symmetrical, and balanced in practice.

Figure 18:
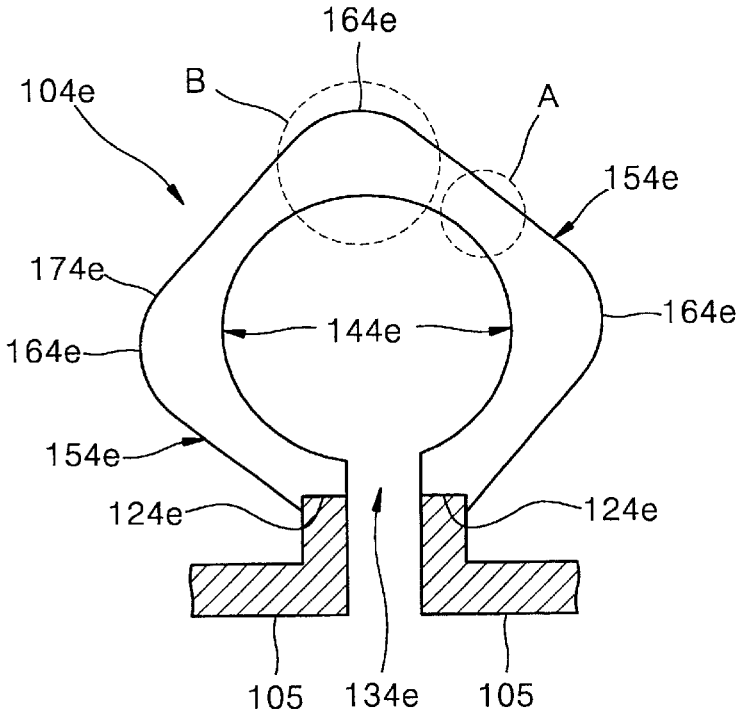
Figure 19:
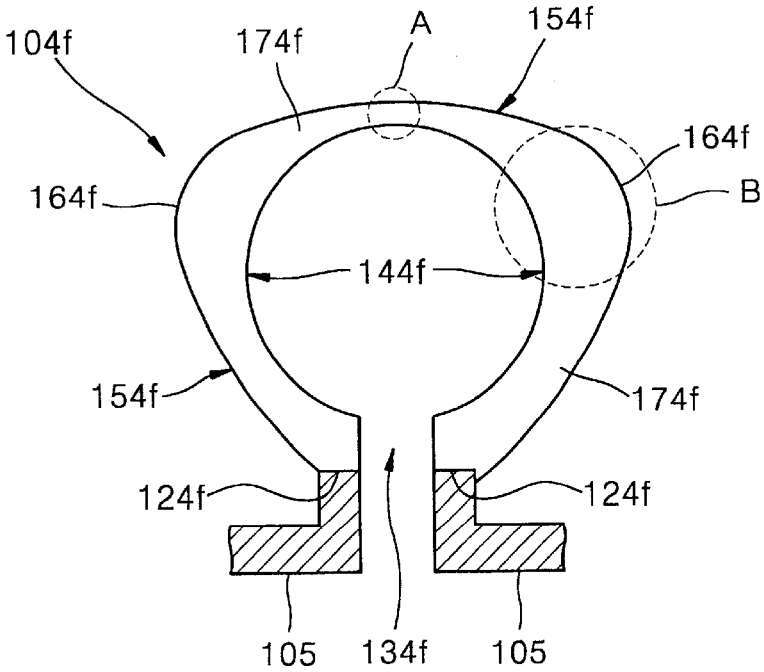

FIGS. 18 and 19 show an modified example of the resistive layer applied to a bubble-jet type ink-jet printhead according to the present invention. Each of resistive layers 104*e* and 104*f* shown in FIGS. 18 and 19 has a shape, one side of which is open, and includes a high resistance portion A and a low resistance portion B like the resistive layer 104*c* shown in FIG. 15. As shown in FIGS. 18 and 19, predetermined current is applied to the resistive layers 104*e* and 104*f* through wiring layers 105 connected to ends 124*e* and 124*f* of heaters 104*e* and 104*f* respectively. Ends 124*e* and 124*f* are generated by the fact that resistive layers 104*e* and 104*f* are discontinuous and open at openings 134*e* and 134*f*, respectively. Resistive layers 104*e* and 104*f* have circular inner edges 144*e* and 144*f*, respectively, and polygonal outer edges 154*e* and 154*f*, respectively. Resistive layer 104*e* has three rounded corners 164*e* and resistive layer 104*f* has two rounded corners 164*f*. Body 174*e* of resistive layer 104*e* is formed between outer edge 154*e* and inner edge 144*e* while body 174*f* of resistive layer 104*f* is bounded by outer edge 154*f* and inner edge 144*f*. As illustrated in FIGS. 18 and 19, the widths of bodies 174*e* and 174*f* of resistive layers 104*e* and 104*f* vary at different locales, causing the resistance of resistive layers 104*e* and 104*f* to vary at different locales. Because of this, a temperature rise rate at the high resistance portion A is higher than that at the low resistance portion B due to the difference in resistance at each portion of the resistive layers 104*e* and 104*f*. Thus, a temperature at each portion of the resistive layers 104*e* and 104*f* varies due to the difference in the temperature rise rate, thus forming bubbles in a way similar to that shown in FIG. 16. Meanwhile, although the resistance of the resistive layers 104*e* and 104*f* may vary due to the difference in the widths of the resistive layers 104*e* and 104*f*, it is possible to vary the resistance thereof by changes in thickness.

Figure 20:
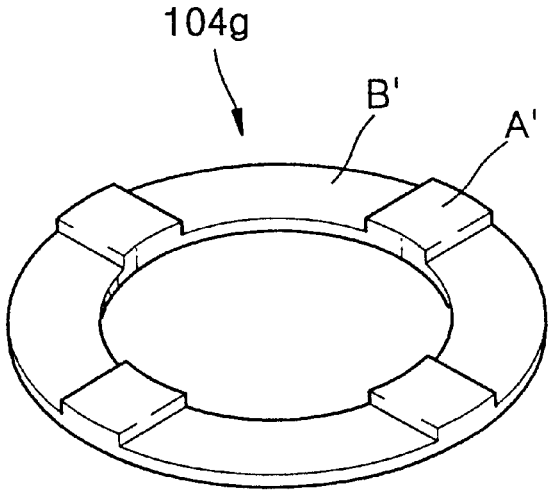
Figure 21:
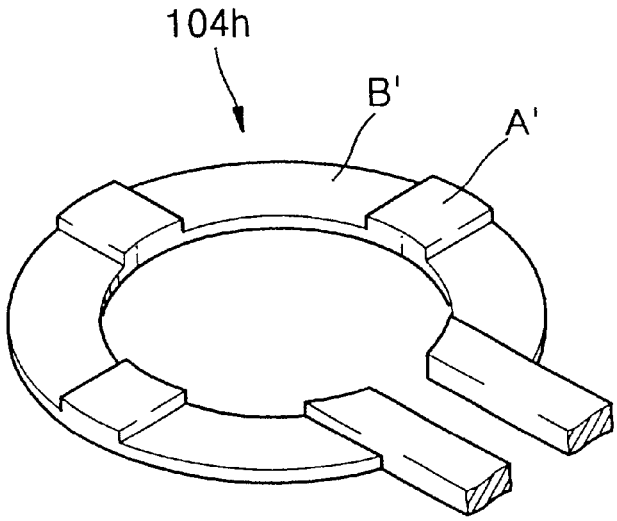

FIGS. 20 and 21 show a doughnut shaped resistive layer 104*g*, which is completely closed, and a doughnut-shaped resistive layer 104*h*, one side of which is open, respectively. As shown in FIGS. 20 and 21, each of the resistive layers 104*g* and 104*h* has a low resistance portion A' having low resistance due to a large thickness and a high resistance portion B' having higher resistance due to a small thickness than the low resistance portion A'. The difference in resistance causes bubbles to be generated through the heaters 104*g* and 104*h* in a way similar to that shown in FIGS. 18 and 19. In an ink-jet printhead according to the present invention, the resistive layer may take on a variety of forms as described above, and design changes in adjacent elements adapted thereto may be made.

Figure 22:
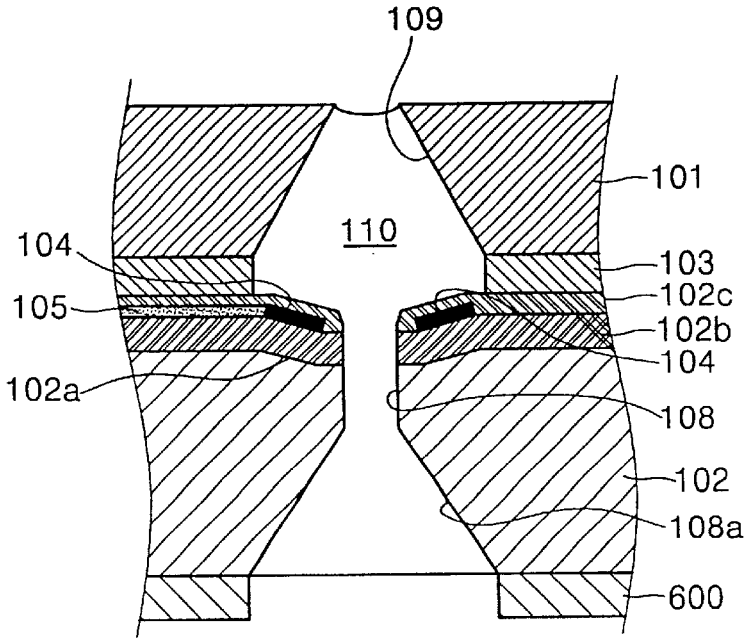
FIG. 22 is an enlarged view of portions of the substrate and the nozzle plate around the resistive layer in a bubble-jet type ink-jet printhead according to the present invention.

FIG. 22 is an enlarged view of portions of the substrate and the nozzle plate around the resistive layer in an ink-jet printhead according to the present embodiment of the present invention described with reference to FIGS. 5–8. As shown in FIG. 22, an insulating layer 102*b* is formed on the substrate 102 on which the concave portion 102*a* has been formed, on top of which the resistive layer 104 is formed. A protective layer 102*c* for preventing the ink from contacting the resistive layer 104 is formed on the resistive layer 104.

Although the insulating layer 102*b* and the protective layer 102*c* have not been described with reference to the previous embodiments of the present invention, they may be selectively adopted in all of the previous embodiments. The insulating layer 102*b* works as a thermal resistor for thermal insulation so as to prevent heat generated from the resistive layer 104 from being transferred to the substrate 102. The insulating layer 102*b* is formed of a material such as $SiO_2$, and the protective layer 102*c* is formed of a material such as $Si_3N_4$.

The vibration element 600 is disposed on the bottom of the substrate 102. A electrical signal line connected to the vibration element 600 is omitted in the drawing. The vibration element 600 is provided for seceding foreign materials such as ink accumulated from the top surface of the substrate 102 by vibration. The vibration element 600 may be selectively applied to all the embodiments of this invention. Other embodiments of this invention include, but are not limited to, using resistive layer 104*a* of FIG. 13, resistive layer 104*b* of FIG. 14, resistive layer 104*c* of FIG. 15, resistive layer 104*e* of FIG. 18, resistive layer 104*f* of FIG. 19, resistive layer 104*g* of FIG. 20 or resistive layer 104*h* of FIG. 21 in place of resistive layer 104 of FIG. 8 in the structure of FIG. 22.

Figure 23A:
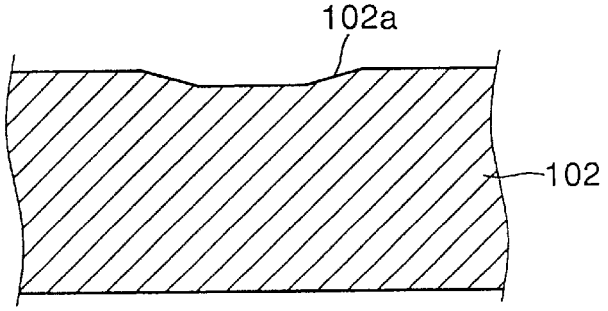
FIGS. 23A–23I show a process of fabricating a bubble-jet type ink-jet printhead according to the present invention.
Figure 23B:
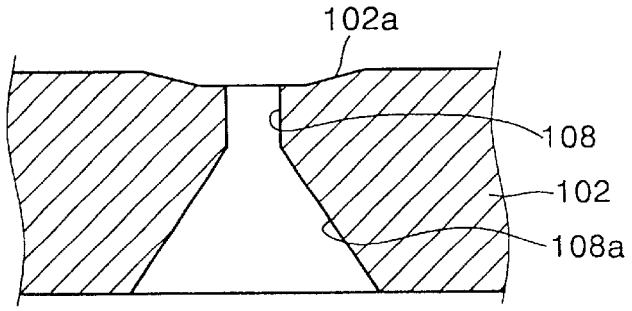
Figure 23C:
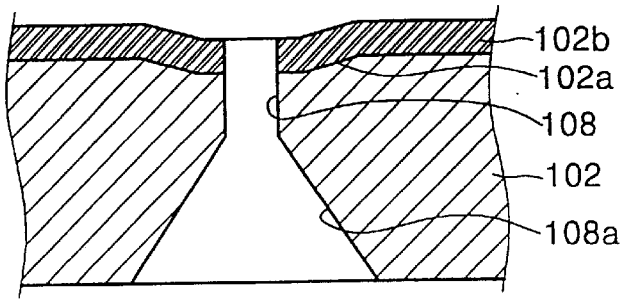
Figure 23D:
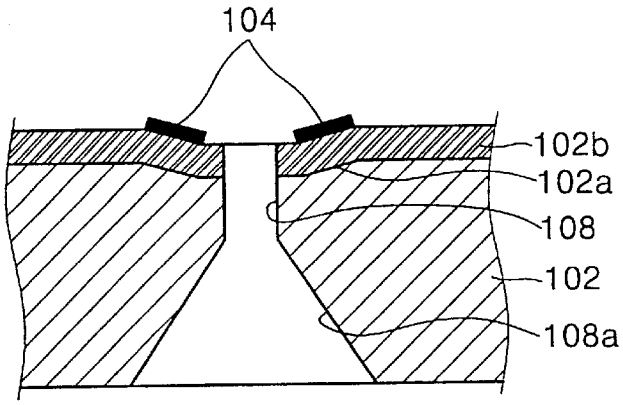
Figure 23E:
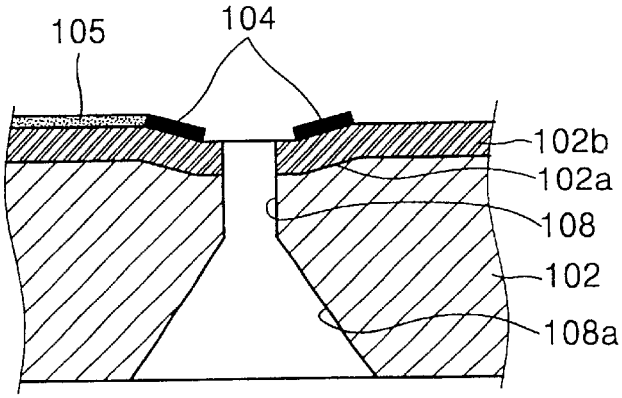
Figure 23F:
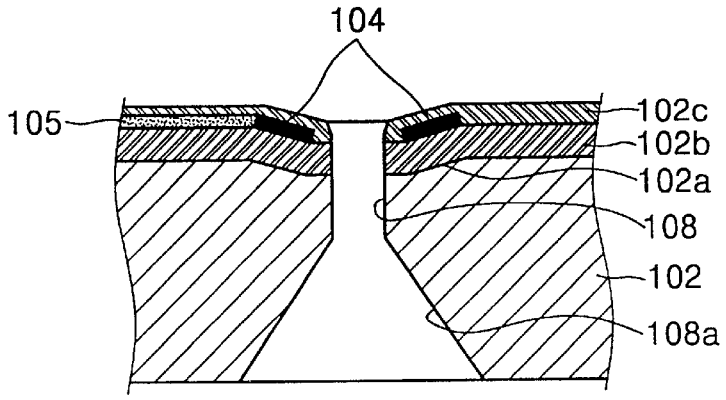
Figure 23G:
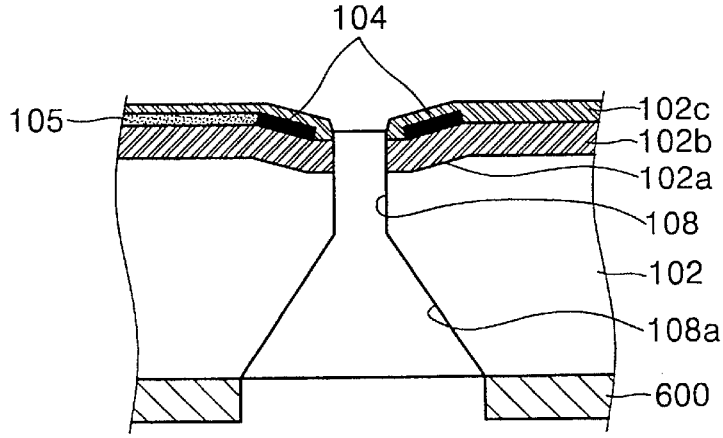
Figure 23H:
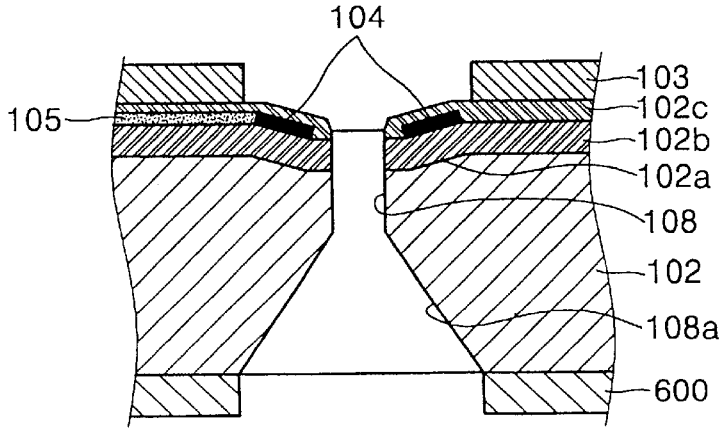
Figure 23I:
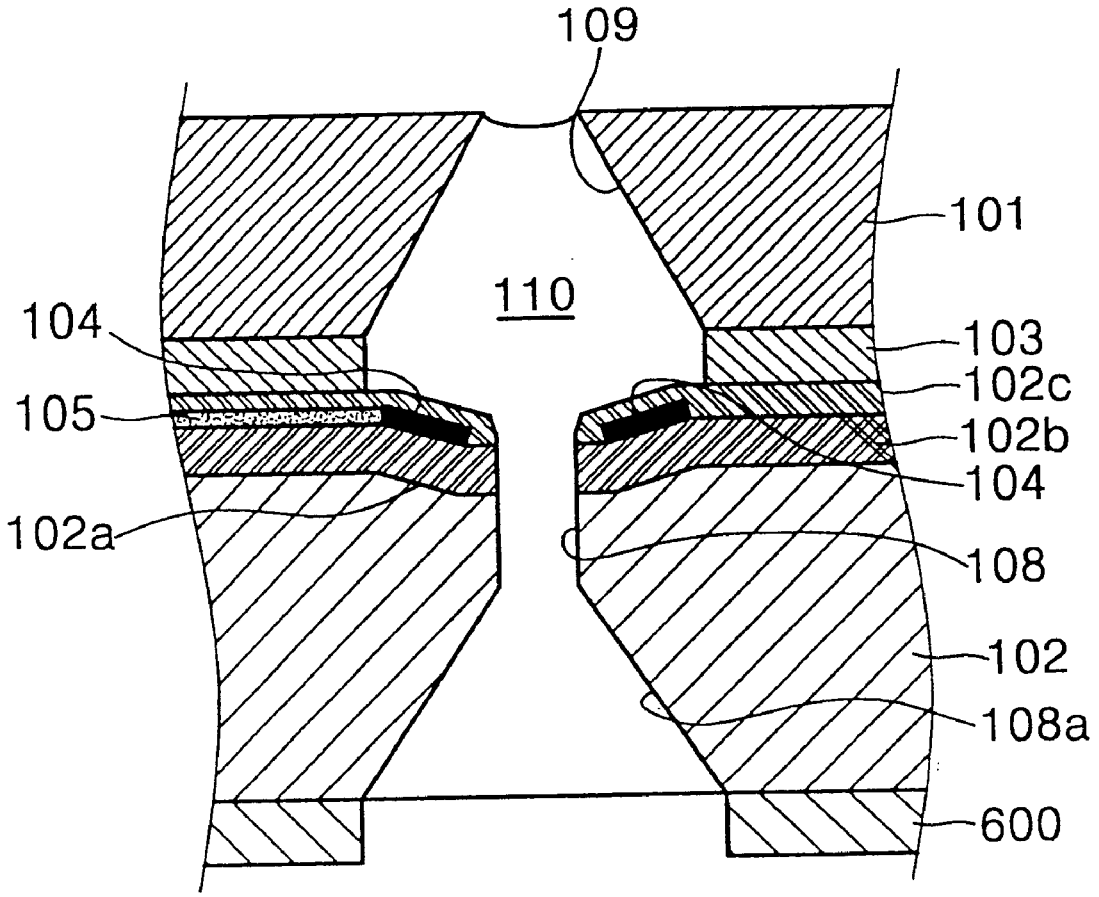

A part of a process of fabricating the ink-jet printhead according to the first embodiment of the present invention will now be described. As shown in FIG. 23A, the tray-type concave portion 102*a* is formed on the substrate 102. As described above, the plurality of concave portions 102*a* are formed opposite the nozzles 108*a* of the nozzle plate 101. As shown in FIG. 23B, the ink feed groove 108 and the ink inlet 108*a* are formed at the bottom center portion of the concave portion 102*a*. As shown in FIG. 23C, the insulating layer 102*b* formed of $SiO_2$ is deposited over the substrate 102. As shown in FIG. 23D, the resistive layer 104 having a predetermined shape is formed on the concave portion 102*a* through a predetermined process. Other embodiments of this invention include, but are not limited to, using resistive layer 104*a* of FIG. 13, resistive layer 104*b* of FIG. 14, resistive layer 104*c* of FIG. 15, resistive layer 104*e* of FIG. 18, resistive layer 104*f* of FIG. 19, resistive layer 104*g* of FIG. 20 or resistive layer 104*h* of FIG. 21 in place of resistive layer 104 of FIG. 8 in the structure of FIGS. 23D–23I. As shown in FIG. 23E, a signal line 105 connected to the resistive layer 104*a* is formed of gold, copper, or aluminum on the insulating layer 102*b*. As shown in FIG. 23F, the protective layer 102*c* made of $Si_3N_4$ is deposited on the stack structure. As shown in FIG. 23G, the vibration element 600 is formed of a piezo element on the bottom of the substrate 102. As shown in FIG. 23H, the adhesive layer 103 is formed on the protective layer 102*c*. The adhesive layer 103 includes the through hole 103*a* having a diameter large enough to surround the resistive layer 104. As shown in FIG. 23I, the nozzle plate 101 provided through a separate process is fixed to the top surface of the substrate 102, thereby completing the ink-jet printhead having laminate and combination structures as shown in FIG. 22. Although the above fabrication process relates to a specific embodiment, it is applicable to all other embodiments in which various types of resistive layer are adopted as described above.

An ink-jet printhead according to the present invention provides the ink chamber by the nozzle of the nozzle plate thereby making ink droplets smaller and thus allowing for a high resolution print. In particular, the ink chamber and the ink feed groove are closed by the bubble having annular or doughnut shape or polygonal frame, thereby effectively preventing a back flow of ink. Furthermore, the vibration element is disposed on the bottom of the substrate, which suppresses the clogging of nozzles by particles or solidified ink.

The ink-jet printhead according to the present invention is easy to design and manufacture due to its simple structure thereby significantly reducing the manufacturing cost. In particular, its simple structure permits flexibility in selecting a wide range of alternative designs and thus patterns in which the nozzles are arranged. In particular, the printhead according to the present invention can be manufactured by a fabrication process for a typical semiconductor device, thereby facilitating high volume production.

The ink-jet printhead according to the present invention guarantees a quick response rate and high driving frequency. Furthermore, the doughnut-shaped bubble coalesces at the center of the nozzle, thereby preventing the formation of satellite droplets.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A bubble-jet type ink jet printhead, comprising:

a substrate perforated by a plurality of ink feed holes;

a nozzle plate perforated by a plurality of nozzle holes, said nozzle plate being fixed to a top surface of said substrate by an adhesive layer, each one of said plurality of nozzle holes comprising a central axis, the central axis of each of said plurality of nozzle holes being coincident with the central axis of corresponding ones of said plurality of ink feed holes;

a plurality of concave portions formed on the substrate, each of said plurality of concave portions corresponding to one of said plurality of nozzle holes; and a plurality of resistive layers, each located along the bottoms of corresponding ones of said plurality of concave portions, each of said plurality of resistive layers surrounding a corresponding one of said plurality of ink feed holes.

2. The printhead of claim 1, wherein the plurality of resistive layers are formed in two or more rows on said substrate.

3. The printhead of claim 1, wherein the plurality of nozzles are formed in two or more rows on said nozzle plate.

4. The printhead of claim 1, wherein a portion of each of said plurality of nozzle holes opposing the substrate has a diameter large enough to surround a corresponding one of said plurality of resistive layers.

5. The printhead of claim 1, wherein each of said plurality of ink feed holes has a lower portion and an upper portion, said lower portion intercepting a bottom surface of said substrate, said upper portion intercepting said top surface of said substrate, said upper portion being narrow and cylindrical, said lower portion being conical, wherein a diameter of said lower portion is largest where said lower portion intercepts said bottom surface of said substrate.

6. The printhead of claim 1, wherein each of said plurality of resistive layers has a doughnut shape, one portion of which is open.

7. The printhead of claim 1, wherein each of said plurality of resistive layers has a polygonal shape, one portion of which is open.

8. The printhead of claim 1, wherein an inner side of each of said plurality of resistive layers has an essentially circular shape, an outer side of each of said plurality of resistive layers has a polygonal shape and corners of the outer side of each of said plurality of resistive layers are rounded, wherein one section of each of said plurality of resistive layers is discontinuous and open.

9. The printhead of claim 1, wherein an inner side of each of said plurality of resistive layers has an essentially circular shape, an outer side of each of said plurality of resistive layers has a polygonal shape and a body of each of said plurality of resistive layers is continuous and closed.

10. The printhead of claim 1, wherein one section of each of said plurality of resistive layers is discontinuous and open, and the resistance around a circumference of each of said plurality of resistive layers is varied by varying a width of each of said plurality of resistive layers around the circumference.

11. The printhead of claim 1, wherein each of said plurality of resistive layers has a closed loop shape and the resistance around a circumference of each of said plurality of resistive layers is varied by varying a width of each of said plurality of resistive layers around the circumference.

12. The printhead of claim 1, wherein a thermal insulating layer is disposed between said substrate and said plurality of resistive layers.

13. The printhead of claim 1, wherein a protective layer for protecting said plurality of resistive layers is disposed on said plurality of resistive layers.

14. A bubble-jet type ink jet printhead, comprising:

a substrate perforated by a plurality of ink feed holes, said substrate having a top surface;

a nozzle plate being perforated by a plurality of nozzle holes, said nozzle plate attaching to said top surface of said substrate, each one of said plurality of nozzle holes having a central axis that is aligned with a central axis of said ink feed holes;

a plurality of concave portions formed on the substrate, each of said plurality of concave portions corresponding to one of said plurality of nozzle holes; and a plurality of resistive layers, each located along the bottoms of corresponding ones of said plurality of concave portions and each being located beneath corresponding ones of said plurality of nozzle holes.

15. The apparatus of claim 14, each one of said plurality of resistive layers being electrically connected to a pair of electrodes.

16. The apparatus of claim 15, further comprising an adhesive layer binds said nozzle plate to said top surface of said substrate.

17. The apparatus of claim 14, a portion of each of said plurality of nozzle holes adjacent to said top surface of said substrate having a diameter large enough to surround a corresponding one of said plurality of resistors.

18. The apparatus of claim 14, each one of said plurality of said nozzle holes having a conical shape, a portion of said nozzle hole having the largest diameter being adjacent to said top surface of said substrate.

19. The apparatus of claim 14, further comprising an adhesive layer that binds said nozzle plate to said top surface of said substrate.

20. The apparatus of claim 14, each one of said plurality of resistive layers essentially surrounds corresponding ones of said plurality of ink feed holes.

* * * * *